US006745834B2

(12) United States Patent
Davis et al.

(10) Patent No.: US 6,745,834 B2
(45) Date of Patent: Jun. 8, 2004

(54) COMPLETE TRIP SYSTEM

(75) Inventors: Jabus T. Davis, Katy, TX (US); Douglas W. Jordan, Katy, TX (US); William F. Siersdorfer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 47 days.

(21) Appl. No.: 09/843,009

(22) Filed: Apr. 26, 2001

(65) Prior Publication Data

US 2002/0157829 A1 Oct. 31, 2002

(51) Int. Cl.[7] ..... E21B 43/04
(52) U.S. Cl. ..... 166/250.17; 166/297; 166/278
(58) Field of Search ..... 166/250.01, 250.02, 166/250.17, 278, 276, 297, 55, 227

(56) References Cited

U.S. PATENT DOCUMENTS 4,541,486 A * 9/1985 Wetzel et al. ..... 166/278
4,566,538 A 1/1986 Peterson
5,004,298 A * 4/1991 Boulanger et al. ..... 299/5
5,579,844 A 12/1996 Rebardi et al.
5,810,087 A 9/1998 Patel ..... 166/373
5,950,733 A 9/1999 Patel ..... 166/373
6,085,845 A 7/2000 Patel et al. ..... 166/373
6,206,100 B1 3/2001 George et al.
6,364,017 B1 4/2002 Stout et al.

FOREIGN PATENT DOCUMENTS

GB 2083854 3/1982
GB 2252579 12/1992

* cited by examiner

*Primary Examiner*—William Neuder
(74) *Attorney, Agent, or Firm*—Williams, Morgan & Amerson PC; Jeffrey Griffin; Brigitte Jeffery Echols

(57) ABSTRACT

The present invention discloses apparatus and methods for perforating, completing, testing, and abandoning a wellbore in a single trip. One embodiment of the invention is a method that comprises perforating an interval within the wellbore, positioning a sand screen assembly adjacent the perforated interval, gravel packing the perforated interval, performing testing on the perforated interval, and then abandoning the well, all in a single trip in the wellbore.

22 Claims, 3 Drawing Sheets

COMPLETE TRIP SYSTEM

BACKGROUND OF THE INVENTION

1. Field of the Invention

This invention relates generally to tools used to complete subterranean wells. More particularly the present invention describes a means of perforating, gravel pack completing, testing, and abandoning a well in a single trip.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production testing of the well can begin.

Sand or silt flowing into the wellbore from unconsolidated formations can lead to an accumulation of fill within the wellbore, reduced production rates and causing damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses. The loss of sand from the formation can create void areas and undermine the formation stability, and this can lead to formation collapse and to a total loss of the well's productive capacity. One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is pumped in a liquid slurry down the tubing and through the cross-over, thereby flowing into the annulus between the screen and the wellbore. The liquid forming the slurry leaks off into the formation and/or through the screen, which is sized to prevent the gravel in the slurry from flowing through. The liquid that passes through the screen flows up the tubing and then the cross-over directs it into the annulus area above the packer where it can be circulated out of the well. As a result of this operation, the gravel is deposited in the annulus area around the screen where it forms a gravel pack. The screen prevents the gravel pack from entering into the production tubing. It is important to size the gravel for proper containment of the formation sand, and the screen must be designed in a manner to prevent the flow of the gravel through the screen.

At times it is desirable to complete a zone, perform production tests and then abandon the well, either temporarily or permanently. Offshore exploration wells are often drilled, completed and then flow tested to gain information on the productive capabilities of the field and the extent of the potential recoverable reserves. As there are usually no production facilities, platforms or pipelines in place when these exploration wells are drilled, they must be abandoned following the flow testing. Field development, if it is commenced at all, may occur several years after the discovery well is tested and abandoned. Field development can include the design and construction of fixed or floating production facilities, pipeline design and construction to transport the product to market, and detailed reservoir studies to determine the most economical development plan and the most efficient production rates that can be achieved.

Current methods to complete a well, perform flow tests and then abandon the well involve a number of trips in and out of the well. For example, one trip can be used to perforate the well, another trip can place the sand screens and perform the gravel pack operation, and yet another trip may be required to plug and abandon the well. Each trip in and out of the wellbore results in increased time and expense. Any reduction in the number of trips required to perform these procedures will result in significant cost savings.

There is a need for improved tools and methods to enable an operator to complete a well, perform flow tests and then abandon the well.

SUMMARY OF THE INVENTION

One embodiment of the present invention is a completion apparatus for perforating, completing, testing, and abandoning a wellbore in a single trip that comprises a perforating gun, a sand screen, an isolation valve, a packer, and a workstring. The perforating gun, sand screen, isolation valve and packer can be directly or indirectly mechanically attached to the workstring. The sand screen is typically located above the perforating gun, and the packer and isolation valve are both located above the sand screen and are releasably attached to the workstring. The perforating gun is capable of imposing perforations into a predetermined zone within the wellbore to create a perforated zone. The completion apparatus is longitudinally movable within the wellbore and is capable of positioning the sand screen assembly adjacent to the perforated zone in preparation of a gravel pack operation and flow testing. The workstring is capable of being released from the packer and the isolation valve, thus enabling removal of the workstring from the wellbore after gravel packing and flow testing have been performed.

The isolation valve is movable between an open position and a closed position and comprises a longitudinal flow path and a sealing mechanism whereby fluid flow through the longitudinal flow path is possible when the isolation valve is in its open position and fluid flow through the longitudinal flow path is restricted by the sealing mechanism when the isolation valve is in its closed position. The isolation valve is typically in its open position when the workstring is engaged with the packer and is in its closed position when the workstring is disengaged from the packer. The completion apparatus may also comprise a second packer located between the perforating gun and the sand screen. This second packer is capable of being set within the wellbore to isolate the zone to be perforated and to facilitate well testing subsequent to perforating.

The completion apparatus can further comprise a testing tool that is in communication with the workstring. The testing tool is capable of being located within the wellbore during well testing or can be attached to the well at the surface and capable of performing well testing operations.

Another embodiment of the invention is an apparatus for completing, testing and abandoning a well in a single trip into the wellbore. The apparatus comprises a perforating gun, a sand screen, a testing member and an isolation valve. The apparatus is longitudinally movable within the wellbore and is capable of positioning the perforating gun at a desired location to create a perforated zone and then capable of being re-positioned so that the sand screen is adjacent to the perforated zone. The isolation valve is capable of moving between an open and closed position, and when in its closed position is capable of isolating a perforated zone. The apparatus may further comprise a packer.

Yet another embodiment of the invention is a method of completing, testing, and abandoning a wellbore in a single trip that comprises perforating an interval within the wellbore, positioning a sand screen assembly adjacent the perforated interval, gravel packing the perforated interval, performing production testing on the perforated interval, and abandoning the wellbore, all in a single trip in the wellbore. The well can be killed with hydrostatic fluid pressure after the wellbore is perforated and after the production testing if it is needed. The method can further comprise inserting a tool assembly into the wellbore that includes a perforating gun, sand screen, and packer attached to a workstring, the sand screen being located above the perforating gun and the packer being located above the sand screen, and setting the packer prior to gravel packing the wellbore. Abandoning the wellbore comprises releasing the workstring from the packer and spotting plugs while removing the workstring from the wellbore. The plugs spotted within the wellbore comprise material circulated down the workstring, such as sand or cement. The method can further comprise closing an isolation valve after the well testing and prior to abandoning the wellbore. The above mentioned tool assembly can comprise an isolation valve that closes and isolates the perforated zone either prior to or in conjunction with the release of the workstring from the packer. The isolation valve is capable of restricting the flow of fluids from the formation through the packer. A second packer may be located below the sand screen assembly and above the perforating gun, and set prior to gravel packing. This second packer set below the sand screen can isolate the sand screen from the portion of the wellbore below the perforated zone, sometimes referred to as a sump. Having the sand screen isolated from the sump area will generally enable a better gravel pack than would be achieved if the sump area were left open to the sand screen and the perforated interval.

Yet another embodiment of the invention is a method of completing, testing, and abandoning a wellbore comprising inserting a tool assembly into the wellbore. The tool assembly comprises a perforating gun, a retrievable packer, a sand screen assembly, a permanent packer, and an isolation valve on a workstring. The method involves positioning the perforating gun at a predetermined location within the wellbore, setting the retrievable packer, perforating the wellbore and creating a perforated zone. The retrievable packer is then released, the tool assembly repositioned to place the sand screen assembly substantially adjacent to the perforated zone and the retrievable packer located below the sand screen assembly is set. The permanent packer located above the sand screen assembly is set and a gravel pack operation is performed adjacent the sand screen assembly thereby depositing a gravel pack in the annulus area between the sand screen assembly and the perforated zone. Testing of the perforated zone is then performed. After testing the isolation valve is closed, the workstring is released from the permanent packer, and the wellbore is abandoned while pulling the workstring out of the wellbore. All of the above steps occur in a single trip into the well.

The perforated zone can be flowed back after the well has been perforated if that is desired. If needed, the well can be temporarily killed with hydrostatic fluid pressure prior to releasing the retrievable packer and prior to releasing the workstring from the permanent packer.

DESCRIPTION OF ILLUSTRATIVE EMBODIMENTS

Figure 1:
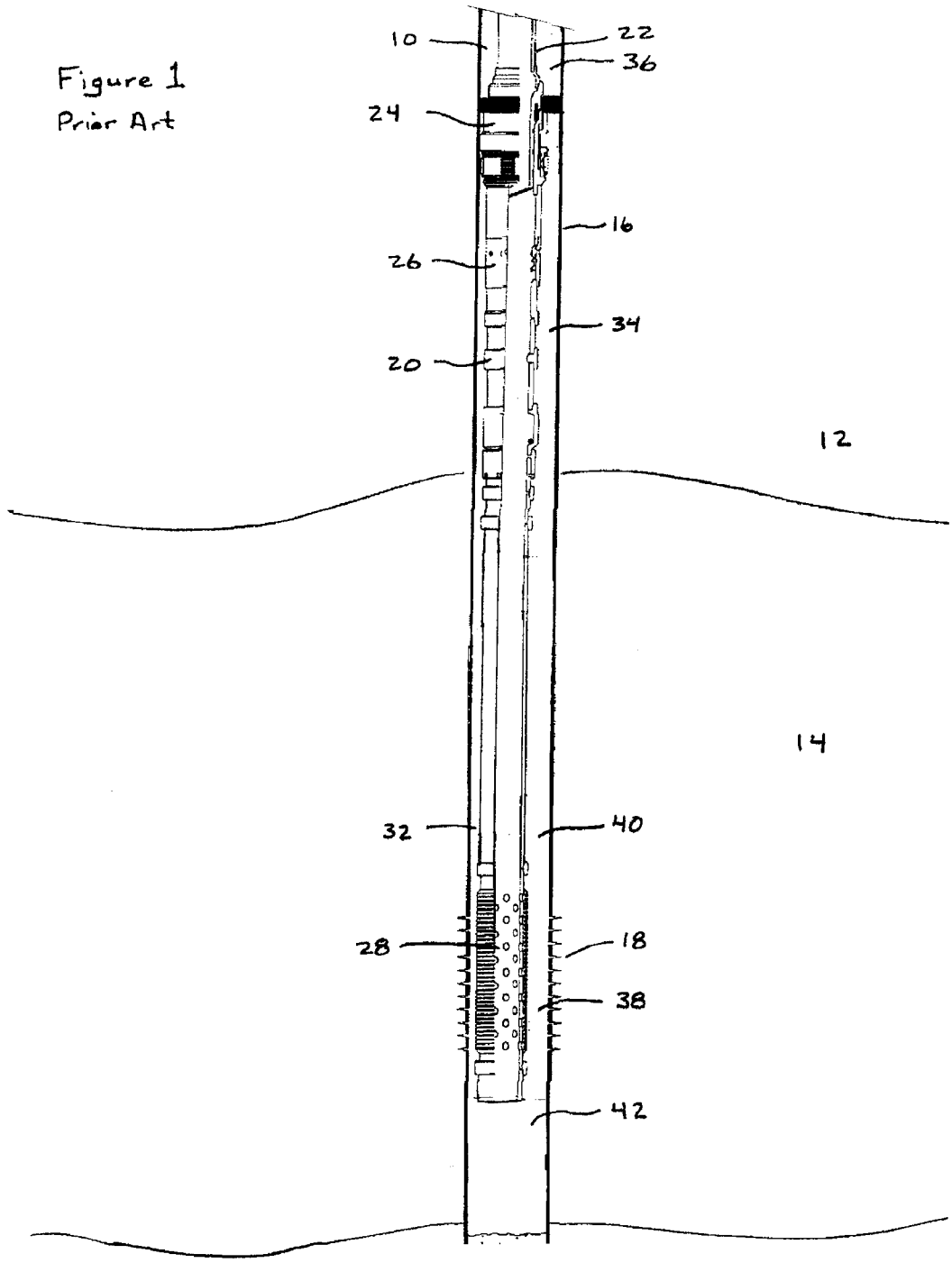
Figure 1 Prior Art
FIG. 1 is a cross section of a wellbore showing a typical gravel pack completion apparatus. This illustration is of prior art.

Referring to the attached drawings, FIG. 1 is of the prior art and illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed. The perforations 18 were made prior to the installation of the well tool 20 and are typically made from a perforating gun run on a wireline.

The present invention can be utilized in both cased wells and open hole completions. For ease of illustration a cased well having perforations will be shown.

The well tool 20 comprises a tubular member 22 attached to a production packer 24, a cross-over 26, and one or more screen elements 28. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as a production string.

In a gravel pack operation the packer element 24 is set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack. It is desired that the gravel pack completely fill the annulus area 38 adjacent the screen element 28 and extend into the annulus area 40 adjacent the blank pipe above the screen element 28.

The area 42 below the screen element 28 is sometimes referred to as a "sump area" and can cause complications in obtaining and keeping a good gravel pack. The sump 42 as shown in FIG. 1 does not contain a means for the carrier fluid dehydration since there are no perforations nor screen element within the sump 42 through which the fluid can flow. If a gravel pack operation leaves a void area in the sump 42 the gravel placed in the annulus 38 adjacent the screen element 28 can migrate down into the sump 42 and create voids within the gravel pack. This migration of the gravel can be accelerated by the flow of hydrocarbons from the perforations 18, through the annulus 38 and through the screen element 28. This fluid flow can tend to fluidize or "fluff" the gravel pack, allowing the individual gravel grains to be affected by gravitational forces and to settle into the sump area 42. One method to minimize the detrimental effects of the sump area 42 is to locate a second packer (not shown) below the screen element 28. Setting this second packer prior to the gravel pack operation will seal off the sump area 42 and prevent the gravel migration into the sump area as discussed above.

As used herein, the term "screen" includes wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

In a typical well completion, a perforating gun run on tubing or on a wireline will be utilized to perforate the zone to be completed. After the well is perforated a completion assembly as shown in FIG. 1 is inserted into the well and a gravel pack is performed. Once the gravel pack has been accomplished, the completed zone can be tested. Following the testing, if the well is to be abandoned, the well is typically killed using a fluid whose hydrostatic pressure is sufficient to overcome formation pressure of the completed zone. Once the well is killed the tubular member 22 is removed from the packer 24 and pulled out of the well. A bridge plug (not shown) is then typically run into the well and set above the packer. This can be done on tubing or on wireline. Utilizing a tubing string, cement plugs are spotted above the bridge plug and at other locations as the tubing string is removed from the well. These steps require multiple trips into the well with either a wireline or tubing string to accomplish the entire operation of perforating, gravel packing, flow testing, and abandoning the well.

Figure 2:
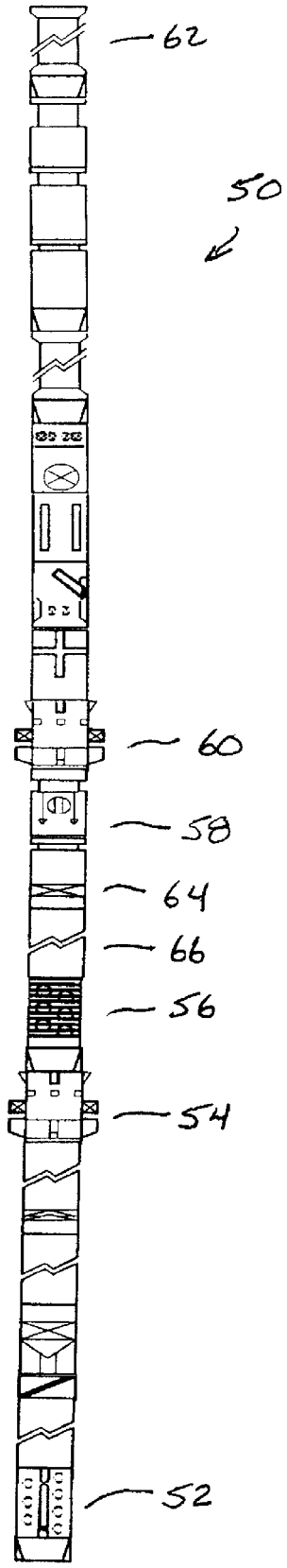
FIG. 2 is an illustration of an embodiment of the present invention.

FIG. 2 illustrates an embodiment of the present invention that enables the perforating, gravel packing, testing, and abandonment of the well in a single trip. The complete trip system shown generally as 50 comprises a perforating gun 52, a retrievable packer 54, sand screens 56, an isolation valve 58, and a production packer 60. These elements are attached to a tubing string 62 that extends to the surface.

To utilize this embodiment the complete trip system 50 is inserted into the wellbore to be completed such that the perforating gun 52 is positioned adjacent the zone to be completed. The retrievable packer 54 is set to isolate the zone to be perforated from the fluids within the wellbore. The perforating guns 52 are then detonated, creating perforations into the formation to be tested. The perforated formation can be flowed at this time in an attempt to clear the perforations of any debris or damage from the perforating, if desired. Other tests such as pressure or temperature surveys can be conducted as well as initial flow testing. The well is then temporarily killed if needed. The term "kill" the well means imposing a hydrostatic pressure on the formation that is sufficient to balance the formation pressure, thereby preventing the flow of fluids from the formation.

Following the perforation of the zone to be tested, the retrievable packer 54 is released and the complete trip system 50 is lowered until the sand screen 56 is substantially adjacent to the perforated formation. The retrievable packer 54 is again set to seal off the lower portions of the wellbore from the subsequent completion activities. The production packer 60 is set and a gravel pack operation is performed to place a gravel pack in the annulus area between the sand screen 56 and the perforated formation. Gravel laden slurry is pumped down the tubular member 62, exits the tubular member through ports in the cross-over 64 and enters the annulus area between the sand screen 56 and the perforated zone. Slurry dehydration occurs when the carrier fluid leaves the slurry. The carrier fluid can leave the slurry by way of the perforated zone and enter the formation that is being completed. The carrier fluid can also leave the slurry by way of the sand screen 56 and enter the tubular member 62. The carrier fluid flows up through the tubular member 62 until the cross-over 64 places it in the annulus area above the production packer 60 where it can be circulated out of the wellbore at the surface. Upon slurry dehydration the gravel grains should pack tightly together. The final gravel filled annulus area is referred to as a gravel pack. It is typically desired that the gravel pack completely fill the annulus area adjacent the screen element 56 and extend some distance into the annulus area adjacent the blank pipe 66 above the screen element 56, although other system designs can also be implemented.

The terms "adjacent" or "substantially adjacent" that are used in describing the placement of the sand screen in relation to the perforated interval refers to a placement of the sand screen that is within a sufficient proximity to the perforated interval so as to provide an effective flow path for produced fluids between the perforated formation and the sand screen.

Once the gravel pack operation is completed, the formation can be tested. Flow testing generally involves producing the well through restrictions of known size, called chokes, and measuring the productive capacity and the flowing pressures of the well at each choke size. Analysis of the flow rates and pressures at the various choke sizes can give valuable reservoir data and can indicate the general size and productive capacity of the formation. Other testing, such as pressure buildup and drawdown tests can be run and instruments such as downhole pressure measurement devices can be utilized to obtain additional information. Additional testing is also possible, for example, temperature surveys and samples can be taken throughout the depth of the well to determine downhole compositions and whether there may be tendencies of paraffin or scale to deposit or for hydrates to develop within the well.

Testing tools that are used can be of many differing designs and functions, such as the flow chokes described above, down hole sampling instruments and pressure transmitters to name just a few. Many other testing tools and testing methods are known to those skilled in the art and this application does not restrict the present invention to only those types mentioned herein.

After the well testing has been completed, the well may need to be abandoned. If the well has any productive capacity at all it will most likely need to be killed to prevent the continued flow of formation fluids. Once the well has been killed, abandonment of the well can be accomplished with the complete trip system 50 by closing the formation isolation valve 58 and thus isolating the perforated formation from the wellbore above the production packer 60. The tubing string 62 is then disengaged from the production packer 60 and removed from the well. While the tubing string 62 is being removed from the well, sand or cement plugs can be circulated down the tubing string to be spotted within the wellbore.

Figure 3:
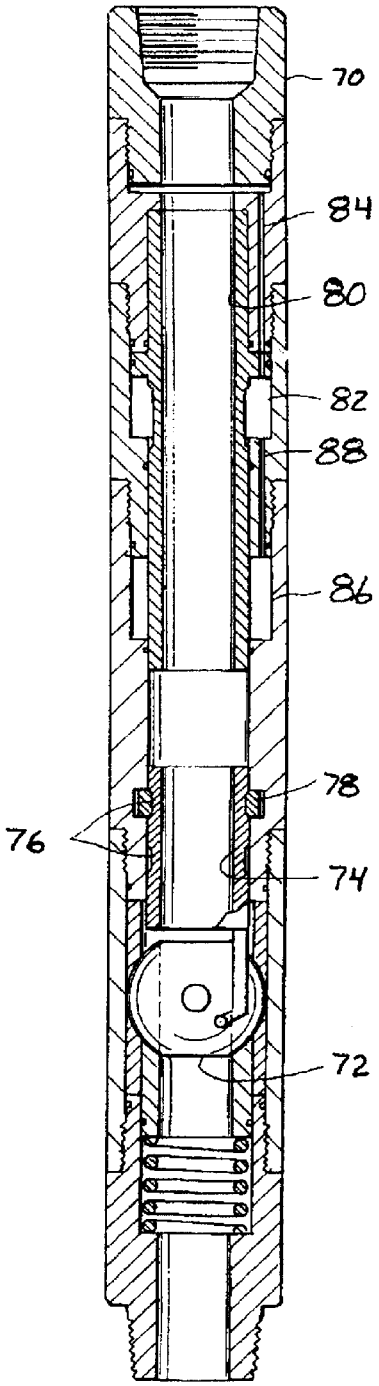
FIGS. 3–5 show an embodiment of an isolation valve.
Figure 4:
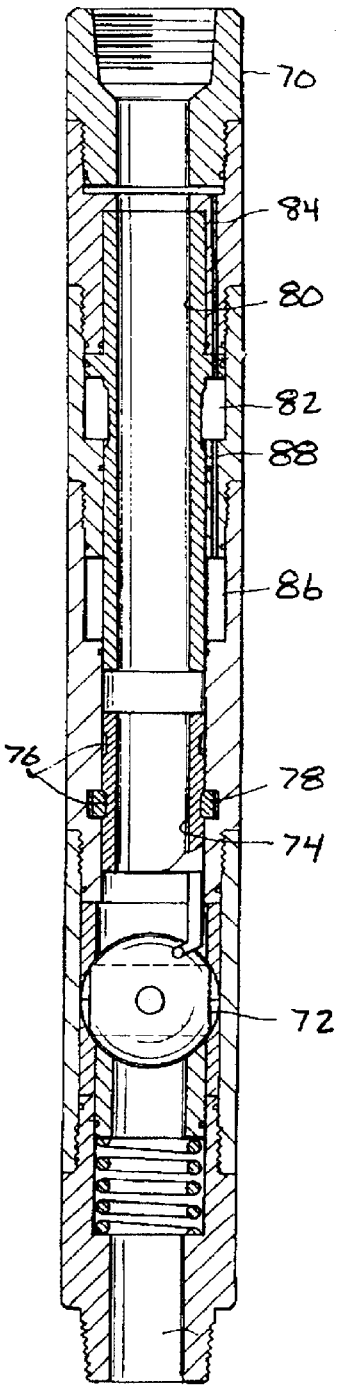
Figure 5:
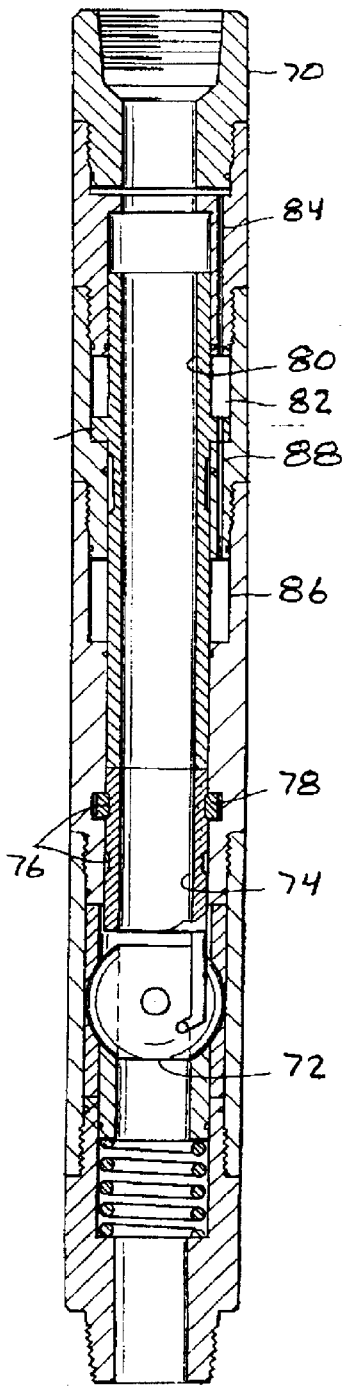

U.S. Pat. Nos. 5,810,087 and 5,950,733 by Patel disclose an isolation valve that is particularly well suited for this application. FIGS. 3–5 illustrate an embodiment of this isolation valve. FIG. 3 shows the isolation valve 70 in its initial run-in open position, FIG. 4 shows the isolation valve 70 in its closed position, while FIG. 5 shows the isolation valve 70 in its reopened position. The valve element in this embodiment comprises a ball valve 72 that is connected to a ball operator 74. The ball operator 74 includes a pair of grooves 76 in which a detent 78 is disposed. An upward longitudinal movement of the ball operator 74 will cause the detent 78 to move out of one groove and fall into the other groove of the pair of grooves 76. This movement will enable the operator to rotate the ball valve from the run-in position shown in FIG. 3 to the closed position shown in FIG. 4. The isolation valve 70 further comprises a mandrel 80 that is held in an upper position by means of an oil chamber 82. Utilizing a rupture disk (not shown) and a liquid passageway 84 connecting the oil chamber 82 and the internal bore of the isolation valve 70, an imposed pressure within the isolation valve can rupture the rupture disk and allow the oil within the oil chamber 82 to communicate through a liquid passageway 88 with an atmospheric chamber 86. As the oil transfers from the oil chamber 82 to the atmospheric chamber 86 the mandrel 80 moves longitudinally from its upper position shown in FIG. 4 to its lower position as shown in FIG. 5. This downward movement of the mandrel 80 will also cause the operator to move downward from its upper position shown in FIG. 4 to its lower position as shown in FIG. 5. When the operator 74 moves downward to its position as shown in FIG. 5, the valve 72 will be rotated from its closed position shown in FIG. 4 to its open position shown in FIG. 5. The ability to reopen the isolation valve is needed when a well is to be temporarily abandoned, but returned to producing status at some time in the future.

Although the isolation valve described above is particularly well suited for use in the this application, the present invention is not limited to this particular embodiment and can comprise other valve embodiments, designs and operating mechanisms than those shown. Examples of possible variations to the isolation valve design can include the use of a flapper type valve instead of a ball valve and the utilization of a mechanical or electrical drive means to move the valve between the open and closed positions.

If it is desired to reenter the well at some later date the well may be temporarily abandoned.

Referring again to FIG. 2, a temporary abandonment of the well can be accomplished by spotting sand on the top of the production packer 60 and the closed isolation valve 58, followed by spotting balanced cement plugs at various locations while pulling the tubing string 62 out of the well. At a future date the well can be reentered, the cement plugs drilled out, the sand circulated off the top of the production packer 60 and the isolation valve 58, the tubing string 62 inserted into the production packer 60, and the isolation valve 58 opened to allow production from the completed formation to be produced through the sand screen 56, isolation valve 58, packer 60 and through the tubing string 62 to the surface.

A permanent abandonment of the well is accomplished in the same manner as the temporary abandonment described above, except that a cement plug is placed on top of the production packer 60 and isolation valve 58 instead of sand. The cement plug prevents the reentering of the production packer 60 or the opening of the isolation valve 58.

It is possible with the use of the present invention to perforate, gravel pack, flow test, and abandon a well in a single trip, by conducting the steps discussed above. The reduction in the number of trips needed to perform these procedures, by utilizing the present invention, will result in substantial savings of time and expense associated with evaluating exploration wells.

The discussion and illustrations within this application refer to a vertical wellbore that has casing cemented in place and comprises casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method, comprising:

perforating a zone within a well;

positioning a sand screen assembly adjacent the perforated zone;

gravel packing the perforated zone;

performing well tests on the perforated zone; and abandoning the well, wherein the method is performed in a single trip into the well.

2. A method, according to claim 1, further comprising killing the well with hydrostatic fluid pressure after perforating the zone and after performing the well tests on the perforated zone.

3. A method, according to claim 1, further comprising:

positioning a tool assembly comprising a perforating gun, a sand screen, and a first packer attached to a tubing string into a wellbore of the well; and setting the first packer prior to gravel packing the perforated zone.

4. A method, according to claim 3, wherein abandoning the well further comprises releasing the tubing string from the first packer and placing plugs in the wellbore while removing the tubing string from the wellbore.

5. A method, according to claim 4, wherein placing the plugs further comprises circulating at least one of sand and cement down the tubing string.

6. A method, according to claim 3, further comprising releasing the tubing string from the first packer and closing an isolation valve no later than releasing the tubing string from the first packer.

7. A method, according to claim 6, wherein closing the isolation valve restricts a flow of fluid from the well through the first packer.

8. A method, according to claim 3, further comprising setting a second packer, disposed between the sand screen and the perforating gun, before gravel packing the perforated zone.

9. A method, according to claim 1, further comprising closing an isolation valve after performing the well tests and before abandoning the well.

10. A method, according to claim 9, wherein closing the isolation valve further comprises moving an operator to close a sealing mechanism of the isolation valve.

11. A method, according to claim 9, further comprising opening the isolation valve after closing the isolation valve.

12. A method, according to claim 9, wherein opening the isolation valve further comprises moving an operator to open a sealing mechanism of the isolation valve.

13. A method, according to claim 12, opening the isolation valve further comprises moving a mandrel to move the operator.

14. A method, according to claim 13, wherein moving the mandrel further comprises flowing a fluid from a first chamber to a second chamber to move the mandrel.

15. A method, comprising:

inserting a tool assembly attached to a tubing string into a wellbore, the tool assembly comprising a perforating gun, a sand screen, a retrievable packer disposed below the sand screen, a production packer disposed above the sand screen, and an isolation valve;

positioning the tool assembly such that the perforating gun is at a predetermined location within the wellbore;

setting the retrievable packer;

perforating a zone proximate the perforating gun to create a perforated zone;

releasing the retrievable packer;

positioning the tool assembly such that the sand screen is substantially adjacent the perforated zone;

setting the retrievable packer;

setting the production packer;

performing a gravel pack operation adjacent the sand screen such that a gravel pack is deposited in an annulus portion between the sand screen and the perforated zone;

testing the perforated zone;

closing the isolation valve;

releasing the tubing string item the tool assembly; and abandoning the wellbore while pulling the tubing string from the wellbore, wherein the method is performed in a single trip into the well.

16. A method, according to claim 15, further comprising flowing back the perforated zone after perforating the wellbore.

17. A method, according to claim 15, further comprising temporarily killing the wellbore with hydrostatic fluid pressure before releasing the retrievable packer, before closing the isolation valve, and before releasing the tubing string from the tool assembly.

18. A method, according to claim 15, wherein closing the isolation valve further comprises moving an operator to close a sealing mechanism of the isolation valve.

19. A method, according to claim 15, further comprising opening the isolation valve after closing the isolation valve.

20. A method, according to claim 19, wherein opening the isolation valve further comprises moving an operator to open a sealing mechanism of the isolation valve.

21. A method, according to claim 20, wherein opening the isolation valve further comprises moving a mandrel to move the operator.

22. A method, according to claim 21, wherein moving the mandrel further comprises flowing a fluid from a first chamber to a second chamber to move the mandrel.

* * * * *